US008960320B2

(12) United States Patent
Moyer

(10) Patent No.: US 8,960,320 B2
(45) Date of Patent: Feb. 24, 2015

(54) INLINE PLUG FLAME ARRESTORS

(75) Inventor: Daniel Glen Moyer, Marshalltown, IA (US)

(73) Assignee: Fisher Controls International LLC, Marshalltown, IA (US)

( * ) Notice: Subject to any disclaimer, the term of this patent is extended or adjusted under 35 U.S.C. 154(b) by 566 days.

(21) Appl. No.: 12/616,954

(22) Filed: Nov. 12, 2009

(65) Prior Publication Data

US 2011/0108292 A1 May 12, 2011

(51) Int. Cl.
*A62C 8/00* (2006.01)
*A62C 4/00* (2006.01)

(52) U.S. Cl.
CPC ..... *A62C 4/00* (2013.01)
USPC ..... 169/48; 239/488

(58) Field of Classification Search
USPC ..... 239/470, 469, 472, 494, 488; 73/706; 220/88.1, 88.2
See application file for complete search history.

(56) References Cited

U.S. PATENT DOCUMENTS 1,449,949 A * 3/1923 McDole ..... 239/476
1,688,585 A * 10/1928 Lalor ..... 239/488
3,100,084 A * 8/1963 Biber ..... 239/463
4,072,799 A * 2/1978 Leeson et al. ..... 429/82
4,317,868 A 3/1982 Spiegelberg
4,474,331 A * 10/1984 Aprea et al. ..... 239/488
4,757,935 A * 7/1988 Gugel ..... 228/219
4,785,158 A 11/1988 Gaul
4,970,898 A 11/1990 Walish et al.
5,415,233 A 5/1995 Roussakis et al.
5,713,205 A * 2/1998 Sciocchetti et al. ..... 60/740
5,794,707 A 8/1998 Alhamad
5,948,988 A 9/1999 Bodin
(Continued)

FOREIGN PATENT DOCUMENTS

CN 1764830 4/2006
DE 4338013 4/1995
(Continued)

OTHER PUBLICATIONS

"International Search Report," issued by the International Searching Authority in connection with International Application No. PCT/US2010/053841, on Feb. 16, 2011, 4 pages.
(Continued)

*Primary Examiner* — Len Tran
*Assistant Examiner* — Viet Le
(74) *Attorney, Agent, or Firm* — Hanley, Flight & Zimmerman, LLC

(57) ABSTRACT

Example inline plug flame arrestors are disclosed. A disclosed example flame arrestor includes a body having a passage to enable fluid communication between a first end of the passage and a second end of the passage, wherein the first end of the passage includes a shoulder and a plug disposed within the passage to substantially fill a cross-sectional area of the passage, wherein a first end of the plug engages the shoulder, wherein the plug is configured to provide a gap between an exterior surface of the plug and a wall of the passage to fluidly couple the first and the second ends of the passage, and wherein the plug includes at least one slot at the first end of the plug extending along an exterior surface of the first end of the plug to a peripheral edge of the first end of the plug to direct fluid flow in the slot toward the wall of the passage and along the gap and the exterior surface of the plug toward the second end of the passage.

22 Claims, 3 Drawing Sheets

(56) References Cited

U.S. PATENT DOCUMENTS

| | | | | |
|---|---|---|---|---|
| 6,050,145 | A * | 4/2000 | Olson et al. | 73/706 |
| 6,283,387 | B1 * | 9/2001 | Palestrant | 239/464 |
| 6,844,104 | B2 * | 1/2005 | Cramer et al. | 429/53 |
| 7,398,691 | B2 * | 7/2008 | Lange et al. | 73/706 |
| 2003/0224643 | A1 * | 12/2003 | Starta et al. | 439/246 |
| 2004/0217204 | A1 * | 11/2004 | Sugimoto et al. | 239/494 |
| 2006/0049282 | A1 * | 3/2006 | Bowman et al. | 239/494 |
| 2007/0151352 | A1 | 7/2007 | Lange | |

FOREIGN PATENT DOCUMENTS

| | | |
|---|---|---|
| DE | 102004042835 | 3/2006 |
| JP | SO4-11574 | 0/1929 |
| JP | S54-017534 | 2/1979 |
| JP | H06313525 | 11/1994 |
| JP | 2003207107 | 7/2003 |
| JP | 2005127583 | 5/2005 |

OTHER PUBLICATIONS

Notification of the Third Office Action, English version, issued by the State Intellectual Property Office of the P.R. China, in connection with Chinese Patent Application No. 201080057639.3, on Mar. 14, 2014, 13 pages.

International Preliminary Report on Patentability, issued by the International Bureau of WIPO, in connection with International application No. PCT/US2010/053841, on May 24, 2012, 8 pages.

Notice for Reasons for Rejection, English Language, issued by the Intellectual Property Office of Japan, in connection with Japanese application No. 2012-538833, on Oct. 8, 2014, 11 pages.

* cited by examiner

INLINE PLUG FLAME ARRESTORS

FIELD OF DISCLOSURE

The present disclosure relates generally to flame arrestors and, more particularly, to inline plug flame arrestors.

BACKGROUND

Valve controllers or other process control devices may be operated in environments that are susceptible to explosions or fires. For example, valve controllers may control valves that control oil flow in a refinery or the flow of chemicals in a chemical plant or manufacturing facility. The valve controllers typically include modules having an enclosure or housing that may accumulate fluids and/or gases from the potentially combustible environments. Sparks or overheating by electronics, wiring, or motors within the modules may ignite a fluid inside the module and initiate a flame, a fire, or an explosion. The enclosure or housing may contain the flame, fire, or explosion to within the module. However, the enclosure or housing may include passages or channels that enable a fluid to flow between the outside of the enclosure or housing and the inside of the enclosure or housing to enable electronics of the module to measure properties of the fluid.

Typically, a flame arrestor situated within a channel or passage of the module permits the flow of the fluid through the passage but prevents a flame, a fire, or an explosion from crossing the passage into a potentially combustible environment outside the module. A flame arrestor prevents (e.g., extinguishes) a flame or an explosion from reaching the outside environment by absorbing heat associated with the flame or explosion. Thus, the flame arrestor enables a fluid to enter the module from the outside environment while preventing a fire or explosion from exiting a housing or enclosure of the module and igniting the outside environment.

SUMMARY

Example inline plug flame arrestors are described. An example flame arrestor includes a body having a passage to enable fluid communication between a first end of the passage and a second end of the passage, wherein the first end of the passage includes a shoulder. The example flame arrestor also includes a plug disposed within the passage to substantially fill a cross-sectional area of the passage, wherein a first end of the plug engages the shoulder, wherein the plug is configured to provide a gap between an exterior surface of the plug and a wall of the passage to fluidly couple the first and the second ends of the passage, and wherein the plug includes at least one slot at the first end of the plug extending along an exterior surface of the first end of the plug to a peripheral edge of the first end of the plug to direct fluid flow in the slot toward the wall of the passage and along the gap and the exterior surface of the plug toward the second end of the passage.

Another disclosed example flame arrestor comprises a plug with at least one slot at an end of the plug and extending along an exterior surface of the end to a peripheral edge of the end to direct fluid flow in the slot toward an exterior surface of the plug. Yet another flame arrestor comprises a plug with at least one slot at an end of the plug and at least one passage within the plug to enable fluid communication between the at least one slot and an exterior surface of the plug.

Furthermore, another disclosed flame arrestor includes a body having a passage to enable fluid communication between a first end of the passage and a second end of the passage, wherein the second end of the passage is to receive a flame originating from a combustible environment. The example flame arrestor also includes a plug disposed within the passage and configured to substantially fill a cross-sectional area of the passage with a first end of the plug and provide a gap between an exterior surface of the plug and a wall of the passage to fluidly couple the first and the second ends of the passage, wherein the plug includes at least one slot at the first end of the plug extending along an exterior surface of the first end of the plug to a peripheral edge of the first end of the plug to direct fluid in the slot toward the wall of the passage and along the gap and to extinguish a flame propagating from the second end of the passage to the first end of the passage.

DETAILED DESCRIPTION

Figure 1:
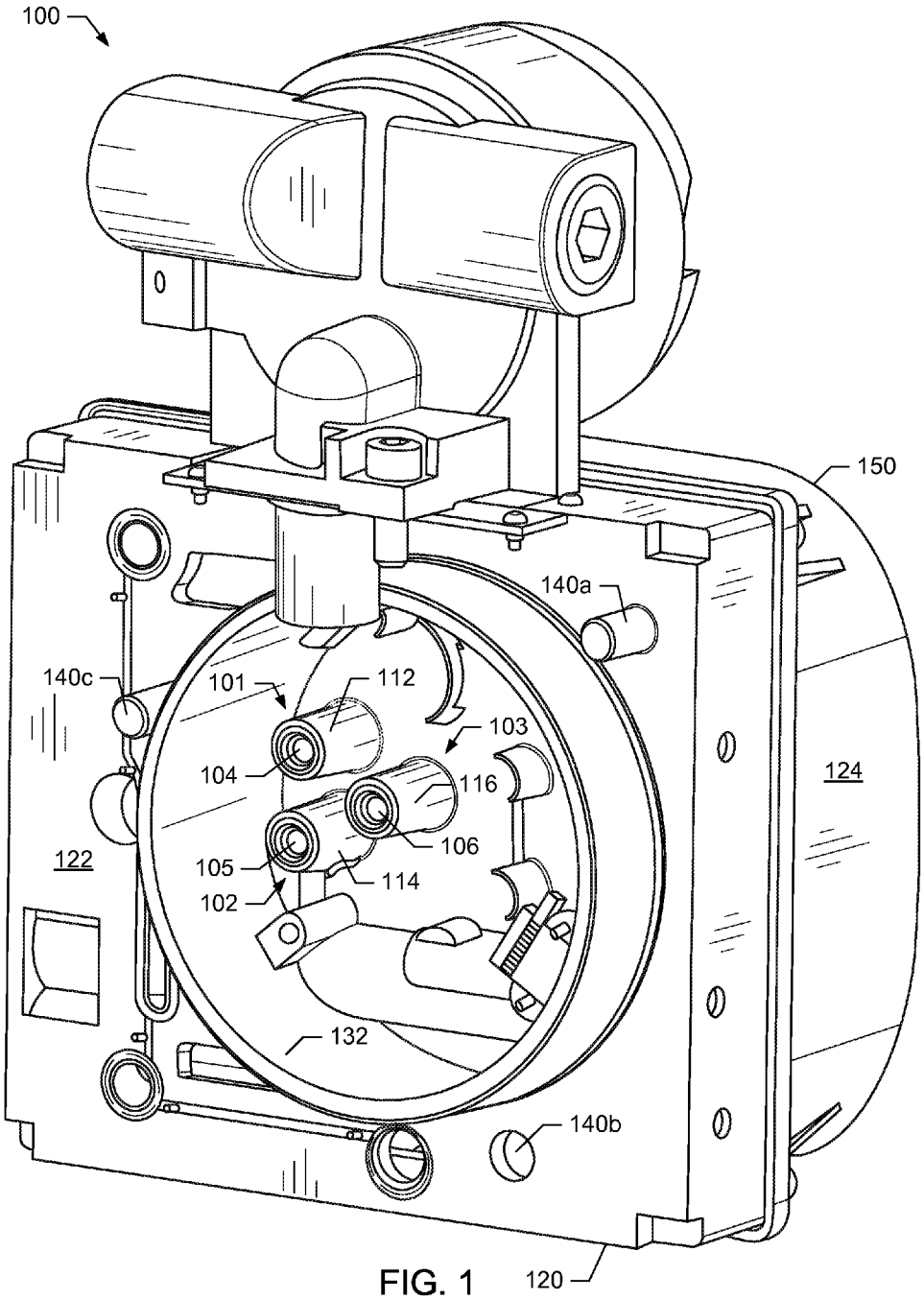
FIG. 1 is diagram of a digital valve controller that includes example flame arrestors.

The example flame arrestors described herein may be used to prevent flames, fires, and/or explosions from reaching a combustible environment. While the example flame arrestors are described in conjunction with a valve controller, the example flame arrestors may be used with other devices, bodies, channels, passages, and/or barriers.

Valve controllers and other devices may be operated in combustible environments. Such combustible environments may include energy generation systems, chemical refineries, and/or any other process control environment that involves fluids that are susceptible to flames, fires, and/or explosions. A flame, fire, and/or explosion within a combustible environment may result in significant damage to a process plant and/or surrounding areas.

A valve controller and/or other device may allow gases and/or liquids from a combustible environment to migrate into the device where electronics, sensors, and/or other components may have the potential to ignite the gas and/or liquid via sparking, shorting, overheating, etc. Any ignition within the device should be maintained within the device to prevent a flame, fire, and/or an explosion from reaching the combustible environment and causing a significantly larger fire, flame, and/or explosion.

In some examples, a valve controller and/or device may measure properties of a fluid that is open to the combustible environment. These properties may be measured with sensors and/or other electrical devices (e.g., printed circuit boards (PCBs), microelectromechanical systems (MEMS), integrated circuits, processors, memory, discrete components, and/or active components). The properties may be measured to control a chemical reaction, regulate a fluidic pressure, regulate a gas or a fluid concentration, measure environmental conditions in a control system, monitor a gas or a fluid for impurities, etc. However, to prevent a flame, fire, and/or explosion from propagating from the sensors and/or electronics, a flame arrestor may be placed within an enclosure or housing (e.g., a body of the device) between the outside environment and the electronics. Typical solutions to enable the gas or the fluid to pass through the enclosure or housing while preventing a flame or an explosion from propagating from the electronics include one or more passages within the enclosure or housing. These passages fluidly link the potentially combustible environment with the electronics but include one or more interposing flame arrestors to prevent an explosion and/or a flame from reaching the potentially combustible environment.

In general, a flame arrestor prevents (e.g., extinguishes) a flame, a fire, or an explosion from reaching a potentially combustible environment by absorbing the heat and/or oxygen associated with the flame, the fire, or the explosion. Some known flame arrestors are made of heat absorbing metals and may be designed to fit within a passage that enables a fluid (e.g., air and/or a liquid) to propagate from one end of the passage to the other end of the passage. For example, a sintered flame arrestor may be made from powdered metal that is pressed into a particular shape to fit within the passage. The pressed powered metal forms a metallic sponge-like structure that includes many intersecting holes with various pore sizes. The holes and pores enable a fluid and/or a gas to pass through the flame arrestor while the pressed powdered metal absorbs heat from any flame and/or explosion that may impinge on the flame arrestor.

Another known flame arrestor is constructed from a polyurethane foam coated with nickel. The foam is removed by thermal decomposition. The nickel is then converted into a nickel-chrome alloy by gas diffusion and is compressed based on the corresponding passage. Similar to the pressed powdered metal devices discussed above, the nickel-chrome alloy includes many holes and/or pores that enable a fluid and/or a gas to pass through while absorbing heat from an impinging flame and/or explosion. The nickel and pressed powdered metal examples may be susceptible to cracks between the holes and/or pores that may result in fracturing of the flame arrestor. Further the nickel and the pressed powdered metal examples are relatively complex and costly to manufacture.

In yet another known example, a thin but relatively long rectangular piece of metal may be crimped. The crimped metal may then be wrapped around itself and secured in a sleeve. In another known example, a flame arrestor is constructed from pressed metal wire elements and/or pressed wire mesh. These known devices may function to pass a gas and/or a liquid while restricting a propagating flame. However, these known devices may only be capable of fitting inside relatively large passages.

In another known example, a flame arrestor may be constructed by creating a passage with a hypodermic tube and/or a small hole. The relatively small hole may have a relatively long length that absorbs heat from a propagating flame and/or explosion. However, creating consistent passages in metallic structures with the relatively small hypodermic tube and/or the hole may be inefficient and costly.

The example flame arrestors described herein may be implemented with a plug having a slotted first end. The slot may extend along a face or surface of an end of the plug to a peripheral or a circumferential outer surface of the plug. The plug is placed into a passage such that a semi-seal or a partial seal is created between the slotted end of the plug and a shoulder within the passage. Where the slot intersects the peripheral circumferential surface, fluid may bypass the seal between the first end of the plug and the shoulder. Additionally, the plug is sized or dimensioned to fit within the passage to provide a gap between the outer surface of the plug and a wall of the passage, thereby providing a fluid path through the passage. In other words, fluid may propagate through the passage by flowing into the slot, bypassing the partial seal, and flowing in the gap between the outer surface of the plug and the wall of the passage. The example flame arrestors may be used to extinguish a flame and/or prevent an explosion from propagating through the passage by directing a flame and/or explosion along the outer surface of the plug, thereby enabling the plug and/or the wall of the passage in which the plug is disposed to absorb the heat associated with the flame and/or the explosion.

Plugs having slotted ends may be machined from a metal (e.g., stainless steel, aluminum, gold, copper, etc.) and/or a plastic. Further, it is relatively easy and inexpensive to machine a passage to hold the plug and the shoulder against which the end of the plug forms a partial seal. Further, because the slotted end of the plug is configured to direct a fluid, a gas, a flame, and/or an explosion along the exterior surface of the plug through the passage, the example flame arrestors may be employed to prevent a flame and/or an explosion from reaching a combustible environment.

The slot along the face of the end of the example plugs described herein may be machined to have any type of geometry, dimension, and/or depth that enables a fluid to travel along the slot, bypass the partial seal between the end of the plug and the shoulder, and through the passage along the outer surface of the plug. Further, the plugs may be made from stainless steel, aluminum, copper, gold, hard plastic, etc. While the following FIGS. 1-3 are described using the term flame, flame may include a fire, an explosion, and/or any other type of combustion characteristic or product.

Figure 2:
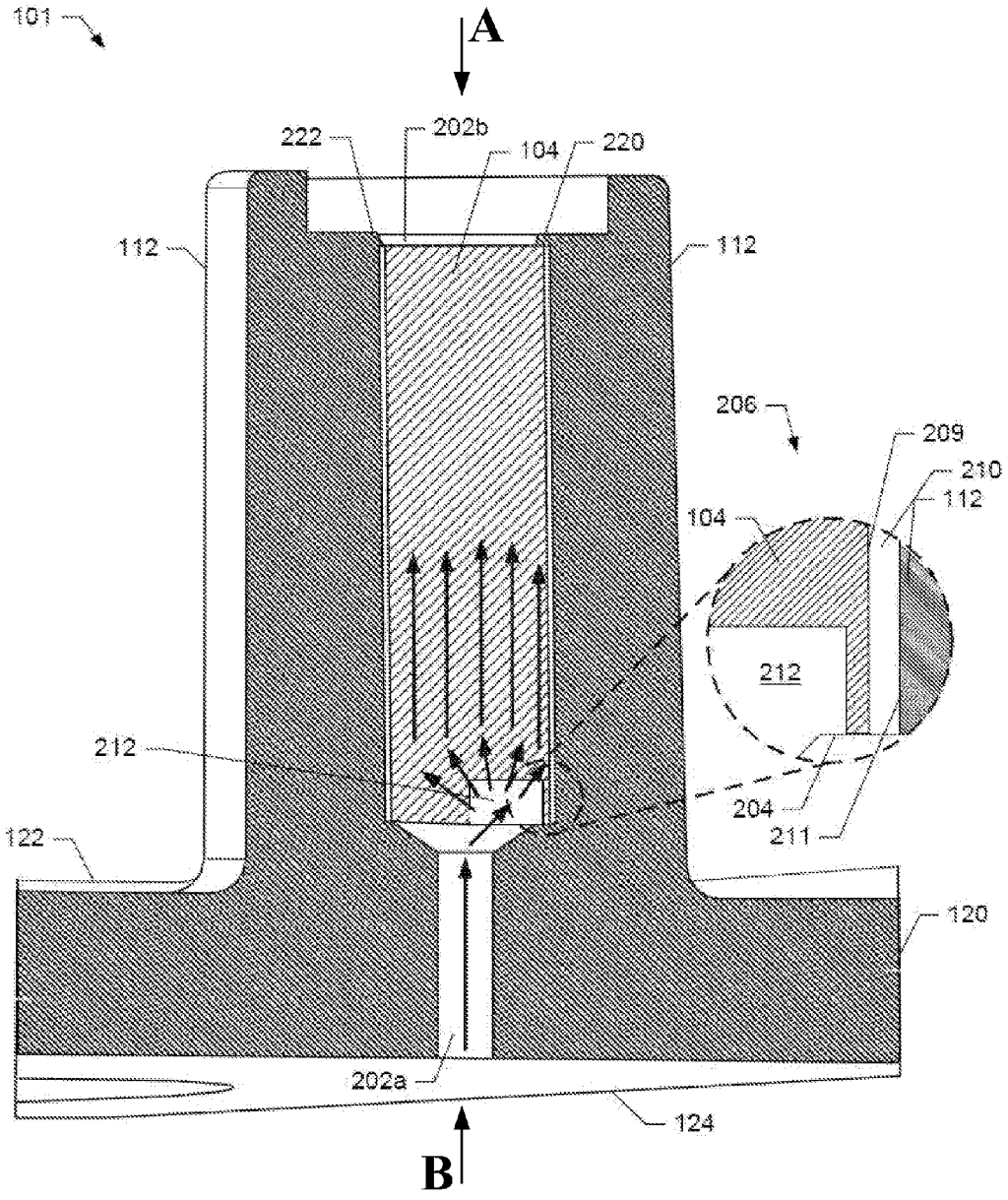
FIG. 2 is a cross-sectional diagram of an example flame arrestor that may be used to implement the example flame arrestors of FIG. 1.

FIG. 1 shows a valve controller 100 that includes example flame arrestors 101, 102, and 103. The example valve controller 100 may be used to control a position of a pneumatic or hydraulic valve utilized within a process control system. The valve controller 100 controls a desired valve by receiving a valve position via an electrical signal and converting the electrical signal into a corresponding pneumatic and/or hydraulic pressure. The valve controller 100 may include sensors, electrical circuitry, amplifiers, and/or converters in a feedback loop configuration to monitor and control the position of the valve.

The example flame arrestors 101, 102 and 103 include respective plugs 104, 105, and 106 and passages and/or channels 112, 114, and 116. For example, the plug 104 and the passage 112 form the first flame arrestor 101, the plug 105 and the passage 114 form the second flame arrestor 102, and the plug 106 and the passage 116 form the third flame arrestor 103. The passages 112-116 are part of a module base, enclosure, housing, and/or a body 120 and provide a propagation path for fluid (e.g., a gas or a liquid) to pass from a first side 122 of the body 120 to a second side 124 of the body 120. The body 120 may be made of stainless steel, aluminum, and/or any other metal or hard plastic.

The first side 122 of the body 120 shows the plugs 104-106 and the respective passages 112-116 within an electronics chamber 132. Electronics and/or sensors may be secured within the chamber 132 via a PCB such that the sensors may measure properties of a fluid that propagates through the passages 112-116. The first side 122 of the body 120 may be coupled to a valve housing (not shown) via connectors 140*a-c*. The connectors 140*a-c* may include bolts, screws, receiving holes, and/or any other connection component(s) to couple the body 120 to the valve housing. The valve housing covers the chamber 132, thereby covering the plugs 104-106, the passages 112-116, and the connectors 140*a-c* such that a partial seal is formed within the chamber 132.

The second side 124 of the body 120 includes a cover 150 that houses relays, current-to-pressure converters (I/P converters), and/or pneumatic amplifiers. The second side 124 may also includes pressure gauges to display a pressure applied to a valve. These gauges are inside the cover 150 and, thus, the cover 150 may be made of a plastic that includes transparent sections to enable an operator to read the gauges through the cover 150. However, because the cover 150 may be made of plastic, the cover 150 may not form a seal against the second side 124 of the body 120. As a result, the cover 150 may not be functional and/or rated to contain a flame, fire, and/or explosion.

When the body 120 is coupled to the cover 150 and the valve housing, pneumatic and/or hydraulic pressures controlled by regulators on the second side 124 of the body 120 are measured by electronics and/or sensors located on the first side 122 of the body 120. The electronics and/or sensors on the first side 122 are physically separated from the pressure regulators on the second side 124 to prevent any sparks and/or heat generated by the electronics from affecting the pressure regulators. However, a pressure of the fluid measured by the sensors propagates between the second side 124 and the first side 122 via the passages 112-116. In other examples, one or more sensors on the first side 122 may additionally or alternatively measure other properties of a fluid including, chemical concentration, temperature, etc. The passages 112-116 include the respective plugs 104-106 to prevent any sparks, heat, flame etc. at the first side 122 from propagating to the second side 124.

The example valve controller 100 of FIG. 1 may be located in and/or around a combustible environment. For example, the valve controller 100 may be located at an oil refinery and control a valve through which oil flows. In other example, the valve controller 100 may be located in a process control environment that includes hazardous, toxic, and/or combustible chemicals. In these environments, fumes, fluids, and/or chemicals may migrate into the valve controller 100 via the boundary between the cover 150 and the second side 124 of the body 120 and/or into the electronics chamber 132 via the partial seal between the first side 122 of the body 120 and the valve housing. In many instances these fumes, fluids, and/or chemicals may not pose a hazard to the normal operation of the valve controller 100. However, in some cases, these fumes, fluids, and/or chemicals may ignite and cause a flame from a spark and/or heat generated by the electronics within the electronics chamber 132. If the flame is permitted to reach the highly combustive environment outside of the valve controller 100, the fire may ignite a larger more destructive fire in the combustible environment that results in widespread damage to the process plant and/or process control system.

When a flame occurs at the first side 122 of the body 120, the chamber 132 directs the flame into the valve housing and away from the partial seal between the body 120 and the housing. Directing the flame into the valve housing prevents the flame from exiting the partial seal between the valve housing and the body 120 because the connectors 140*a-c* keep the valve housing coupled to the body 120 while the mass of the valve housing and/or the body 120 absorbs the heat associated with the flame. However, the passages 112-116 provide a possible flame propagation path to the second side 124 of the body 120. Because the cover 150 is not functional and/or rated to contain a flame, any flame that reaches the second side 124 of the body 120 is considered to reach the external combustible environment of the valve controller 100. In the examples described herein, the flame arrestors 101-103 prevent the propagation of the flame from the first side 122 to the second side 124.

The example plugs 104-106 (e.g., rods, pins, slotted pins, etc.) are disposed within the respective passages 112-116 to substantially fill a cross-sectional area of the passages 112-116. The plugs 104-106 have a diameter smaller than a diameter of the passages 112-116 such that a gap exists between the exterior surface of each of the plugs 104-106 and the wall of the respective one of the passages 112-116, which fluidly couple the second side 124 to the first side 122. Each of the plugs 104-106 has a first end that engages a shoulder within a respective one of the passages 112-116. The first end of each of the plugs 104-106 includes one or more slots that are aligned with a respective one of the passages 112-116 so that a fluid may propagate around or bypass the partial seal between the shoulder and the end of the plug and through the passage. The one or more slots direct fluid flow in the slot(s) toward the wall of the passage and along the gap between the exterior surface of the plug and the passage wall. A further description of the plugs 104-106 is provided below in conjunction with FIG. 2 and example dimensions, shapes, and properties of the slot(s) of the plugs 104-106 are discussed in conjunction within FIG. 3.

While FIG. 1 shows the valve controller 100 with the plugs 104-106, the plugs 104, 104, and/or 106 may be used in other types of passages or channels that enable a fluid to pass from one side of a body to another side of the body but prevent a flame and/or explosion from propagating through the passage and/or channel. In other examples, the valve controller 100 may include additional or fewer flame arrestors and/or passages. Further, in other examples, the passages 112-116 and the respective plugs 104-106 may be located at different locations on the body 120 than those depicted in FIG. 1.

FIG. 2 is a cross-sectional diagram of an example manner of implementing the flame arrestor 101 that includes the plug 104 and the passage 112 of FIG. 1. The plug 104 is disposed within the passage 112, which includes a first end 202*a* and a second end 202*b*. The passage 112 extends between the first end 202*a* at the second side 124 of the body 120 and the second end 202*b* at the first side 122 of the body 120. In the example of FIG. 2, the first end 202*a* of the passage 112 is relatively narrow or has a relatively small cross-sectional area up to a shoulder 204, at which point the passage 112 widens to accommodate the plug 104. In other words, a diameter of the passage 112 is substantially constant from the second end 202*b* of the passage to the shoulder 204 and decreases from the shoulder 204 toward the first end 202*a* of the passage 112. In other examples, the first end 202*a* of the passage 112 may be relatively wider or the same width as the second end 202*b*.

In the example of FIG. 2, the plug 104 may have a length of 11.9 millimeters (mm) and a diameter of 3.9 mm. In other examples, the plug 104 may have a different length and/or diameter. Further, the plug 104 may be made of stainless steel (e.g., SST316) or aluminum alloy (e.g., A96061). In other examples, the plug 104 may be made of plastic and/or another other metal or metal alloy. The body 120 may be made of alloy steel (e.g., A360), stainless steel (e.g., CF8M) and/or any other type of metal, plastic, or metal alloy. The passage 112 may be drilled (e.g., cored) and/or etched into the body 120. In other examples, the plug 104, the passage 112 and/or the body 120 may be formed via metal injection molding, casting, machining, and/or any other metal forming process.

An enlarged view 206 highlights the boundary of the plug 104 with the shoulder 204 to create a partial seal. The partial seal is created by the end of the plug 104 engaging the shoulder 204. The enlarged view 206 also shows that the plug 104 has a width (e.g., a diameter) that is less than the diameter of the passage 112 to provide a gap 210 between an outer surface 209 of the plug 104 and a wall 211 of the passage 112. The gap 210 enables a fluid to flow through the passage 112 between the wall 211 of the passage 112 and the exterior surface 209 of the plug 104. The gap 210 between the exterior surface 209 of the plug 104 and the wall 211 of the passage 112 may range from about 0.0001 mm to 2.0 mm or 0.05% to 10% of a diameter of the plug 104. In other examples, the gap 210 may range from a few millimeters to a few centimeters. The gap 210 may be a few centimeters wide in applications that require a relatively long and wide passage. In some examples, the gap 210 may exist between the entire exterior surface 209 of the plug 104 and the wall 211 of the passage 112. In other examples, the gap 210 may exist between only a portion of the exterior surface 209 of the plug 104 and the wall 211 of the passage 112 such that fluid may still propagate from the first end 202*a* to the second end 202*b* of the passage 112.

The enlarged view 206 also shows a slot 212 at a first end of the plug 104. To enable fluid flow from the first end 202*a* to the second end 202*b* of the passage 112, the example slot 212 may be aligned with the first end 202*a* of the passage 112 such that a fluid may flow into the slot 212 and then into the gap 210 where the slot 212 prevents the end of the plug 104 from engaging (e.g., sealing against) the shoulder 204. The example slot 212 is shown as having a rectangular shape that extends a distance into the plug 104 such that fluid from the first end 202*a* of the passage 112 can propagate (as shown by the arrows) into the slot 212 to bypass the partial seal of the plug 104 at the shoulder 204. The fluid may then propagate from the slot 212 through the passage 112 via the gap 210 to the second end 202*b*. The example slot 212 may extend across the entire diameter of the first end of the plug 104. While the example slot 212 is shown extending into the plug 104 at about 5% of the length of the plug 104, in other example the slot 212 may extend into the plug 104 from about 0.01% to 95% of the length of the plug 104. FIG. 3 shows other example dimensions, geometries, and shapes that may be used to implement the slot 212.

The example plug 104 is secured to the passage 112 via connections 220 and 222. Securing the plug 104 prevents the plug 104 from becoming misaligned with the first end 202*a* of the passage 112 and/or becoming dislodged from the passage 112 during movement and/or during an arresting of a flame. The connections 220 and 222 may include stakes at the second end 202*b* of the passage 112. The connections 220 and 222 may additionally or alternatively be implemented using tabs that engage apertures by welding a portion of a second end of the plug 104 to the passage 112. In other examples, the plug 104 may be secured to the passage 112 by crimping the second end of the plug 104 to the shoulder 204.

The example flame arrestor 101 of FIG. 2 prevents a flame from propagating from the second end 202*b* to the first end 202*a* of the passage 112 (in the direction of arrow A) by directing the flame into the gap 210. Because the gap 210 is relatively narrow or small compared to the length of the passage 112, the length of plug 104, the surface area of the exterior surface 209 of the plug 104, and the surface area of the wall 211 of the passage 112, heat associated with the flame is readily absorbed by the plug 104 and the wall 211 of the passage 112 before the flame can reach the first end 202*a*. The dimensions, geometry, and/or shape of the slot 212 may be constructed to further absorb heat by directing the flame into the slot 212. Additionally, because the plug 104 is secured relative to the shoulder 204 via the connections 220 and 222, any flame, fire, and/or explosion cannot displace the plug 104 from the passage 112. Additionally or alternatively, the plug 104 may also prevent a flame from propagating from the first end 202*a* to the second end 202*b* of the passage 112 (in the direction of arrow B) by restricting the propagation of the flame to the slot 212 and the relatively narrow gap 210.

While the example plug 104 is shown in FIG. 2, other shapes, geometries, and/or dimensions to fit within differently shaped and/or dimensioned passages may be used instead. Further, other plugs configurations may include other structures, indentions, and/or holes based on properties of a passage to provide fluid flow while restricting the propagation of a flame. Still further, the example flame arrestor 101 of FIG. 2 may be used to implement the flame arrestors 102 and 103 of FIG. 1. Alternatively, any other configuration(s) may be used to implement the flame arrestors 101-103.

FIGS. 3A-3D are example cross-sectional diagrams of example manners of implementing the plug 104 of FIG. 2. While FIGS. 3A-3D show example slots 302, 304, 306*a*-I, and 308 that may be formed at a first end of the plug 104, other slots of varying dimensions, shapes, and/or geometries may be formed on the plug 104. For example, additional slots may be shaped like triangles, pentagons, hexagons, etc. Additionally, the plug 104 may include other slots that may have varying depths or include a varying numbers of slots.

Figure 3A:
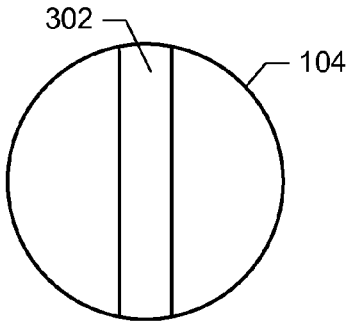
FIGS. 3A-3D are cross-sectional diagrams depicting different manners of implementing the example plug of FIG. 2.

FIG. 3A shows a cross-section of the first end of the example plug 104 with the slot 302. The example slot 302 is rectangular in shape and extends across the diameter of the first end of the plug 104 to intersect the outer peripheral or circumference of the plug 104. In this example, fluid propagates from inside the slot 302 to the edge of the slot 302 at the circumference of the plug 104. The fluid may then propagate along the outer surface of the plug 104.

Figure 3B:
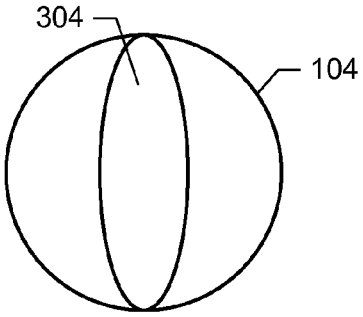
Figure 3C:
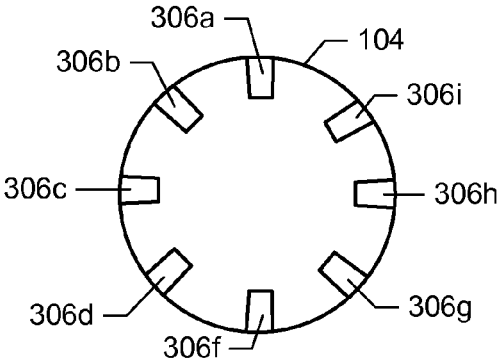

FIG. 3B shows a cross-section of the first end of the example plug 104 with the slot 304. The example slot 304 is similar to the slot 302 but has an elliptical shape that extends a distance into the plug 104 and has a major diameter substantially equal to a diameter of the plug 104. FIG. 3C shows a cross-section of the first end of the example plug 104 with the slots 306*a-i*. The example slots 306*a-i* are rectangular in shape and extend along the face of the first of the plug 104 from inside the outer circumference to the outer circumference. In this example, fluid propagates via each of the slots 306*a-i* to the outer edge of the slots 306*a-i* at the circumference of the plug 104. The fluid may then propagate along the outer surface of the plug 104.

Figure 3D:
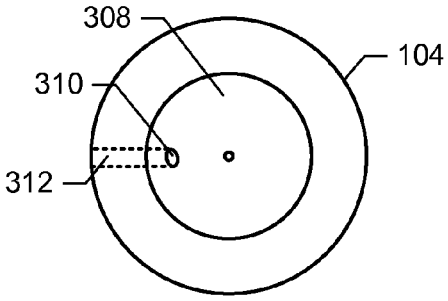

FIG. 3D shows a cross-section of the first end of the example plug 104 with the slot 308. The example slot 308 has a circular face and extends into the plug 104 in a conical shape. The slot 308 is fluidly coupled to the exterior surface of the plug 104 via an opening 310 and passage 312 though the plug 104. The example plug 104 may include additional passages at varying depths. In this example, fluid propagates from inside the slot 308 through the opening 310 and the passage 312 to the circumference of the plug 104. The fluid may then propagate along the outer surface of the plug 104.

Although certain example flame arrestors have been described herein, the scope of coverage of this patent is not limited thereto. On the contrary, this patent covers all apparatus and articles of manufacture fairly falling within the scope of the appended claims either literally or under the doctrine of equivalents.

What is claimed is:

1. A flame arrestor to receive and extinguish a flame originating from a combustible environment, comprising:

a body having a passage to enable fluid communication between a first end of the passage and a second end of the passage, wherein the first end of the passage includes a shoulder; and a plug disposed within the passage to substantially fill a cross-sectional area of the passage, wherein a first end of the plug engages the shoulder, wherein the plug has a substantially constant diameter between the first end of the plug and a second end of the plug, the diameter of the plug being less than a diameter of the passage to provide a gap between an exterior surface of the plug and a wall of the passage to fluidly couple the first and the second ends of the passage, and wherein the plug includes at least one slot at the first end of the plug, wherein the slot is open to the first end of the plug and to the exterior surface of the plug and the slot is to direct fluid flow in the slot toward the wall of the passage and along the gap and the exterior surface of the plug toward the second end of the passage to extinguish a flame propagating between the second end of the passage and the first end of the passage.

2. A flame arrestor as defined in claim 1, wherein the plug is secured to the body.

3. A flame arrestor as defined in claim 2, wherein the plug is secured to the body by at least one of staking the body at the second end of the passage to the plug, creating at least one aperture at the second end of the passage and at least one corresponding tab to engage the aperture, crimping the first end of the plug to the shoulder, or welding a portion of the plug to the body at the second end of the passage.

4. A flame arrestor as defined in claim 1, wherein the gap between the exterior surface of the plug and the wall of the passage is between about 0.0001 millimeters to about 2.0 millimeters.

5. A flame arrestor as defined in claim 1, wherein the gap between the exterior surface of the plug and the wall of the passage is between about 0.05% to about 10% of a diameter of the plug.

6. A flame arrestor as defined in claim 1, wherein a diameter of the passage is substantially constant from the second end of the passage to the shoulder and decreases from the shoulder toward the first end of the passage.

7. A flame arrestor as defined in claim 1, wherein the slot on the first end of the plug includes at least one of a rectangular slot extending a distance into the plug and having a length substantially equal to a diameter of the plug or a curved slot extending a distance into the plug and having a diameter substantially equal to a diameter of the plug.

8. A flame arrestor as defined in claim 7, wherein the at least one of the rectangular slot or the curved slot extends into the plug from about 0.01% to about 95% of the length of the plug.

9. A flame arrestor as defined in claim 1, wherein at least one of the body or the plug comprises at least one of aluminum, plastic, or stainless steel.

10. A flame arrestor as defined in claim 1, wherein the at least one slot at the first end of the plug has a shape that is at least partially circular, rectangular, or triangular.

11. A flame arrestor as defined in claim 1, wherein at least a portion of the slot is open at a portion of the shoulder.

12. A flame arrestor as defined in claim 1, wherein the plug is secured to the body by at least one stake at the second end of the passage that engages the second end of the plug.

13. A flame arrestor plug to extinguish a flame propagating between an outside environment and a combustible environment, comprising:

a first end;

a second end opposite the first end;

an exterior surface having a substantially constant circumference between the first end and the second end;

a slot extending into the plug from the first end of the plug along a longitudinal axis of the plug; and a channel extending between the exterior surface of the plug to the slot inside of the plug, wherein the slot is to direct fluid flow in the slot through the channel to the exterior surface of the plug, wherein when the plug is disposed within a passage of a flame arrestor body having a diameter greater than a diameter of the plug, there is a gap between the exterior surface of the plug and a wall of the passage to extinguish a flame propagating between a first end of the passage and a second end of the passage.

14. A flame arrestor plug as defined in claim 13, wherein the gap fluidly couples first and second ends of the passage.

15. A flame arrestor plug as defined in claim 13, wherein the slot at the first end of the plug includes at least one of a rectangular slot having a length substantially equal to the diameter of the plug or an elliptical slot having a major diameter substantially equal to the diameter of the plug.

16. A flame arrestor, comprising:

a body having a passage and a shoulder within the passage, the passage having a first end and a second end, the passage to receive a flame originating from a combustible environment; and a plug having a first end and a second end opposite the first end, wherein at least a portion of the first end of the plug is to engage the shoulder and the plug includes at least one slot at the first end of the plug, the slot having a first aperture open at the first end of the plug in a first direction and a second aperture open at an exterior side surface of the plug in a second direction, the second direction substantially orthogonal to the first direction, wherein the slot is to enable fluid communication between the first end of the plug and the exterior side surface of the plug, wherein the plug has a substantially constant diameter between the first end of the plug and the second end of the plug, the diameter of the plug being less than a diameter of the passage to provide a gap between the exterior surface of the plug and a wall of the passage, and wherein the slot is to direct fluid from the first end of the plug toward the wall of the passage and along the gap to extinguish a flame propagating between the second end of the passage and the first end of the passage.

17. A flame arrestor as defined in claim 16, wherein the plug is secured to the body by at least one connector between the body and the second end of the plug.

18. A flame arrestor, comprising:

a body having a passage to enable fluid communication between a first end of the passage and a second end of the passage, wherein the second end of the passage is to receive a flame originating from a combustible environment; and a plug disposed within the passage to:

substantially fill a cross-sectional area of the passage with a first end of the plug; and provide a gap between an exterior side surface of the plug and a wall of the passage to fluidly couple the first and the second ends of the passage, wherein the plug includes at least one slot at the first end of the plug extending along an exterior end surface of the first end of the plug to a peripheral edge of the first end of the plug and open at the peripheral edge to the exterior side surface of the plug to direct fluid in the slot toward the wall of the passage and along the gap and to extinguish a flame propagating from the second end of the passage to the first end of the passage.

19. A flame arrestor as defined in claim 18, wherein the propagating flame is to be extinguished by at least one of the plug or the wall of the body absorbing heat associated with the flame.

20. A flame arrestor as defined in claim 18, wherein the second end of the passage is adjacent to at least one sensor and in proximity to a combustible environment and the first end of the passage is in proximity to an outside environment protected by the flame arrestor from being ignited by the combustible environment.

21. A flame arrestor, comprising:

a body having a passage to enable fluid communication between a first end of the passage and a second end of the passage, wherein the first end of the passage includes a shoulder; and a plug disposed within the passage to substantially fill a cross-sectional area of the passage, wherein a first end of the plug engages the shoulder, wherein the plug is configured to provide a gap between an exterior surface of the plug and a wall of the passage to fluidly couple the first and the second ends of the passage, and wherein the plug includes at least one slot at the first end of the plug, wherein the slot is open to the first end of the plug and to the exterior surface of the plug and the slot is to direct fluid flow in the slot toward the wall of the passage and along the gap and the exterior surface of the plug toward the second end of the passage, and wherein the second end of the passage is adjacent to a printed circuit board including at least one sensor and the first end of the passage is to be in proximity to a combustible environment.

22. A flame arrestor, comprising:

a body having a passage to enable fluid communication between a first end of the passage and a second end of the passage, wherein the first end of the passage includes a shoulder; and a plug disposed within the passage to substantially fill a cross-sectional area of the passage, wherein a first end of the plug engages the shoulder, wherein the plug is configured to provide a gap between an exterior surface of the plug and a wall of the passage to fluidly couple the first and the second ends of the passage, and wherein the plug includes at least one slot at the first end of the plug, wherein the slot is open to the first end of the plug and to the exterior surface of the plug and the slot is to direct fluid flow in the slot toward the wall of the passage and along the gap and the exterior surface of the plug toward the second end of the passage, and wherein the second end of the passage is adjacent to at least one sensor and is to be in proximity to a combustible environment and the first end of the passage is to be in proximity to an outside environment to be protected from being ignited by the combustible environment by the flame arrestor.

* * * * *